US006370736B1

(12) United States Patent
Pferdmenges et al.

(10) Patent No.: US 6,370,736 B1
(45) Date of Patent: Apr. 16, 2002

(54) DEVICE FOR REMOVING AIR FROM A PNEUMATICALLY CHARGED FIBER TUFT FEEDER

(75) Inventors: Gerd Pferdmenges, Jüchen; Robert Többen, Mönchengladbach, both of (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/588,727

(22) Filed: Jun. 7, 2000

Related U.S. Application Data

(63) Continuation of application No. 09/503,244, filed on Feb. 14, 2000.

(30) Foreign Application Priority Data

Feb. 13, 1999 (DE) ..... 199 06 148

(51) Int. Cl.[7] ..... D01B 1/00
(52) U.S. Cl. ..... 19/97.5; 19/105
(58) Field of Search ..... 19/65 A, 97.5, 19/105, 200, 202, 203, 204, 205

(56) References Cited

U.S. PATENT DOCUMENTS

| | | | | |
|---|---|---|---|---|
| 4,593,436 A | | 6/1986 | Burgess et al. | |
| 4,731,909 A | * | 3/1988 | Duda | 19/105 |
| 4,779,310 A | * | 10/1988 | Leifeld | 19/105 |
| 4,805,266 A | * | 2/1989 | Leifeld et al. | 19/105 |
| 4,811,463 A | * | 3/1989 | Leifeld | 19/105 |
| 5,337,455 A | | 8/1994 | Pinto et al. | |
| 5,737,806 A | * | 4/1998 | Leifeld et al. | 19/105 |
| 6,163,931 A | * | 12/2000 | Leifeld | 19/105 |

FOREIGN PATENT DOCUMENTS

| | | |
|---|---|---|
| DE | 39 04 853 | 8/1990 |
| DE | 40 36 014 | 5/1992 |
| DE | 197 52579 | 11/1998 |
| EP | 0 176 668 | 4/1986 |
| EP | 0 877 106 | 11/1998 |
| GB | 1007772 | 10/1965 |
| GB | 2 043 128 | 10/1980 |

* cited by examiner

*Primary Examiner*—John J. Calvert
*Assistant Examiner*—Gary L. Welch
(74) *Attorney, Agent, or Firm*—Venable; Gabor J. Kelemen

(57) ABSTRACT

A fiber tuft feeder includes a chute; a first air-pervious surface forming part of the chute wall; and a first exhaust air chamber adjoining the first air-pervious surface externally of the interior. The first exhaust air chamber is in a pneumatic communication with the chute through the first air-pervious surface. A device-charges the chute with an air stream carrying fiber tufts. A first part of the air stream is separated from the fiber tufts by, and passing through, the first air-pervious surface into the first exhaust air chamber whereby a fiber tuft column is formed in the chute in the region of the first air-pervious surface. A second air-pervious surface forms part of the chute wall and is situated upstream of the first air-pervious surface. A second exhaust air chamber adjoins the second air-pervious surface externally of the chute interior and is separate from the first exhaust air chamber. The second exhaust air chamber is in a pneumatic communication with the chute interior through the second air-pervious surface for receiving a second part of the air stream. An air outflow opening is provided in a wall of the second exhaust air chamber and an adjustable valve cooperates with the air outflow opening for varying a flow passage area thereof.

20 Claims, 3 Drawing Sheets

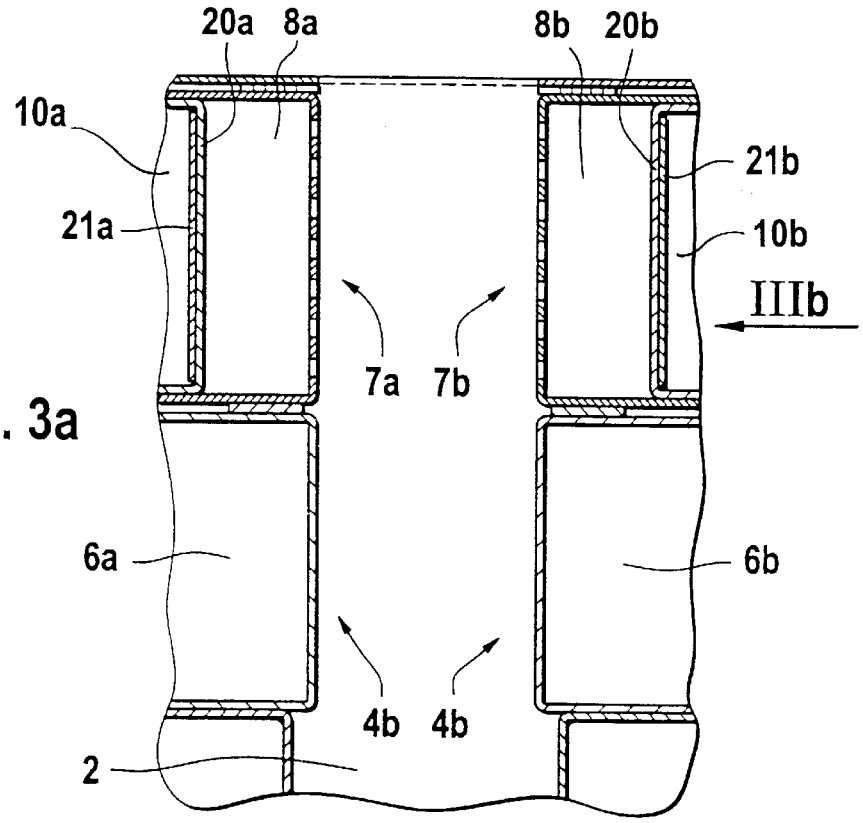
Fig. 3a
Fig. 3b
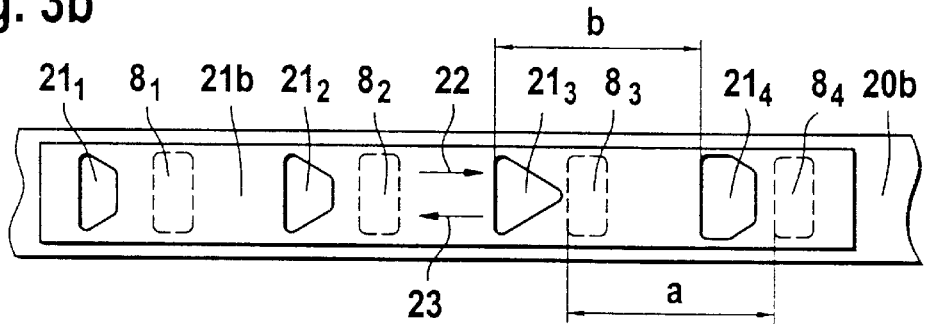
Fig. 3c
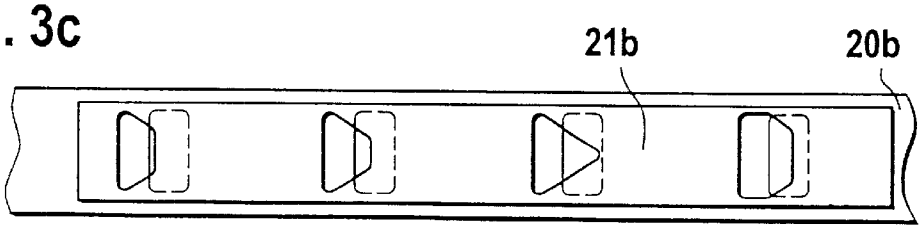

DEVICE FOR REMOVING AIR FROM A PNEUMATICALLY CHARGED FIBER TUFT FEEDER

CROSS REFERENCE TO RELATED APPLICATION

This application is a continuation of pending application Ser. No. 09/503,244 filed Feb. 14, 2000.

This application claims the priority of German Application No. 199 06 148.3 filed Feb. 13, 1999, which is incorporated herein by reference.

BACKGROUND OF THE INVENTION

This invention relates to a fiber tuft feeder particularly for a carding machine, a roller card unit, a cleaner or the like. In particular, the invention concerns a device for charging a chute of the feeder with fiber tufts delivered by a transporting air stream into the chute. The fiber tufts are withdrawn from the chute at another location thereof. A separation of the transporting air stream from the fiber tufts is effected by an air-pervious surface through which the separated transporting air stream enters into an after-connected exhaust air unit which has an exhaust air chamber provided with a valve, such as an adjustable closing element.

European patent document 0 176 668, to which corresponds U.S. Pat. No. 4,878,784, discloses a device for pneumatically charging a chute from the top with fiber tufts which are removed from the chute by a withdrawing roll pair situated at the chute bottom. The device further has an exhaust air chamber which is separated from the chute by an air-pervious chute wall. The exhaust air chamber is connected with an exhaust air conduit by means of an opening in an otherwise impervious wall portion. A shutoff gate cooperates with the opening and is movable into a selectable, partially blocking position for varying the resistance to the air stream passing through the opening. In operation the entire volume of air separated from the fiber tufts passes through the air-pervious wall into the exhaust air chamber. Conventionally, low pressures prevail behind the air-pervious chute wall. By virtue of the higher charging pressure in the chute, differential pressures are obtained which may cause high flow velocities through the air-pervious chute walls. Such high velocities result in a lap formation with satisfactory width distribution and compression. Lap formation begins immediately where the air is capable of exiting the chute and the fiber tufts are entrained by the high-speed air flow and impact on the air-pervious surface. The air stream automatically guides larger fiber tuft quantities to a location where the material column in the chute is the shallowest because the resistance to the air flow is the lowest there. In fractions of a second the air flow equalizes differences in the height level of the tuft column over the entire width of the feed chute and thus an excellent uniformity of the fiber lap over the entire chute width is obtained.

Since the fiber lap is very intensively compressed aerodynamically over a small height difference, the air-pervious chute wall contributes only very little to the outflow of air below the upper level of the material mass. Disadvantageously, through the resulting, significantly reduced air outlet surface only a very small air quantity may exit and contribute to the lap formation. It is a further disadvantage that the air quantities required for the fiber transport are significantly greater than what would be needed for an optimal lap formation. Problems may be encountered particularly in case of large outputs in which partially significantly higher air transport quantities are required. The increased air transport quantity exceeds the air quantity required for the lap formation and clogging may result which prevents lap formation and causes operational disturbances.

SUMMARY OF THE INVENTION

It is an object of the invention to provide an improved device of the above-outlined type from which the discussed disadvantages are eliminated, which, in particular, permits the use of increased transport air quantities and which makes possible in a simple manner an undisturbed lap formation.

This object and others to become apparent as the specification progresses, are accomplished by the invention, according to which, briefly stated, the fiber tuft feeder includes a chute, a first air-pervious surface forming part of the chute wall and a first exhaust air chamber adjoining the first air-pervious surface externally of the chute. The first exhaust air chamber is in a pneumatic communication with the chute through the first air-pervious surface. A device charges the chute with an air stream carrying fiber tufts. A first part of the air stream is separated from the fiber tufts by, and passing through, the first air-pervious surface into the first exhaust air chamber whereby a fiber tuft column is formed in the chute in the region of the first air-pervious surface. A second air-pervious surface forms part of the chute wall and is situated upstream of the first air-pervious surface. A second exhaust air chamber adjoins the second air-pervious surface externally of the chute and is separate from the first exhaust air chamber. The second exhaust air chamber is in a pneumatic communication with the chute interior through the second air-pervious surface for receiving a second part of the air stream. An air outflow opening is provided in a wall of the second exhaust air chamber and an adjustable valve cooperates with the air outflow opening for varying a flow passage area thereof.

By means of the additional (second) air-pervious surface one part of the tuft-transporting air stream in the chute is separated from the fiber tufts already above the (first) air-pervious surface associated with the fiber tuft column. By integrating the additional air-pervious surface in the chute region, a subsequent fiber tuft transport is enhanced by gravity. By virtue of the adjustability of the air outlet of the upper (second) exhaust air chamber, the differential pressure may be maintained small at the additional air-pervious surface (sieve, perforated plate or comb), while the outlet surface is maintained constant. The pressure in the second exhaust air chamber is increased by throttling until the desired air quantity flows to the lower-lying air-pervious surface. In this manner, a stepped air outlet in chute sections of different height may be set. At the same time, the measures according to the invention make possible an increased output with undisturbed fiber lap formation.

The invention has the following additional advantageous features:

The air-pervious surface associated with the deposited fiber tufts (first air-pervious surface) is adjoined by an independent exhaust air chamber.

The valve is adjoined by an exhaust air channel.

Both exhaust air chambers are coupled to the exhaust air channel.

The counter pressure in the exhaust air chamber adjoining the second air-pervious surface can be set by the adjustable valve which may be an adjustable throttle slide and which may be set as a function of the volume of the transporting air stream.

At least two second air-pervious surfaces are provided in respective opposite chute walls.

At least two second air-pervious surfaces are provided which extend throughout the width of the respective chute wall.

The second air-pervious surfaces are situated side by side.

A displaceable closure element is provided which may open or close at least two air outflow openings and which may be movable in a horizontal direction.

The displaceable closure element has air passage openings and blocking elements for controlling the air outflow openings.

The displaceable closure element has blocking surfaces for the air outflow openings.

The displaceable closure element permits a simultaneous shift of the blocking elements and the air passage openings.

The air outflow openings and the air passage openings have unlike shapes; the air outflow openings are rectangular or quadratic and the air passage openings have other polygonal shapes.

The air passage openings are triangular or trapezoidal.

The distance between the air outflow openings is uniform.

The shape of the air passage openings is different.

The free surface of the air outflow openings is so configured that over the entire width of the chute a uniform transport air stream is obtained.

The chute is the reserve chute of a fiber tuft feeder and a feed chute adjoins the reserve chute downstream thereof.

At the lower end of the reserve chute a tuft advancing assembly is arranged which has a rapidly rotating opening roll.

The distance between the air passage openings is uniform.

BRIEF DESCRIPTION OF THE DRAWINGS

FIG. 3*a* is a fragmentary sectional side elevational view of yet another preferred embodiment of the invention.

FIG. 3*b* is a front elevational view of a component of the construction shown in FIG. 3*a* as seen in the direction of the arrow IIIb and illustrating blocked air outflow openings.

FIG. 3*c* is a view similar to FIG. 3*b* showing partially unblocked air outflow openings.

DESCRIPTION OF THE PREFERRED EMBODIMENTS

Figure 1:
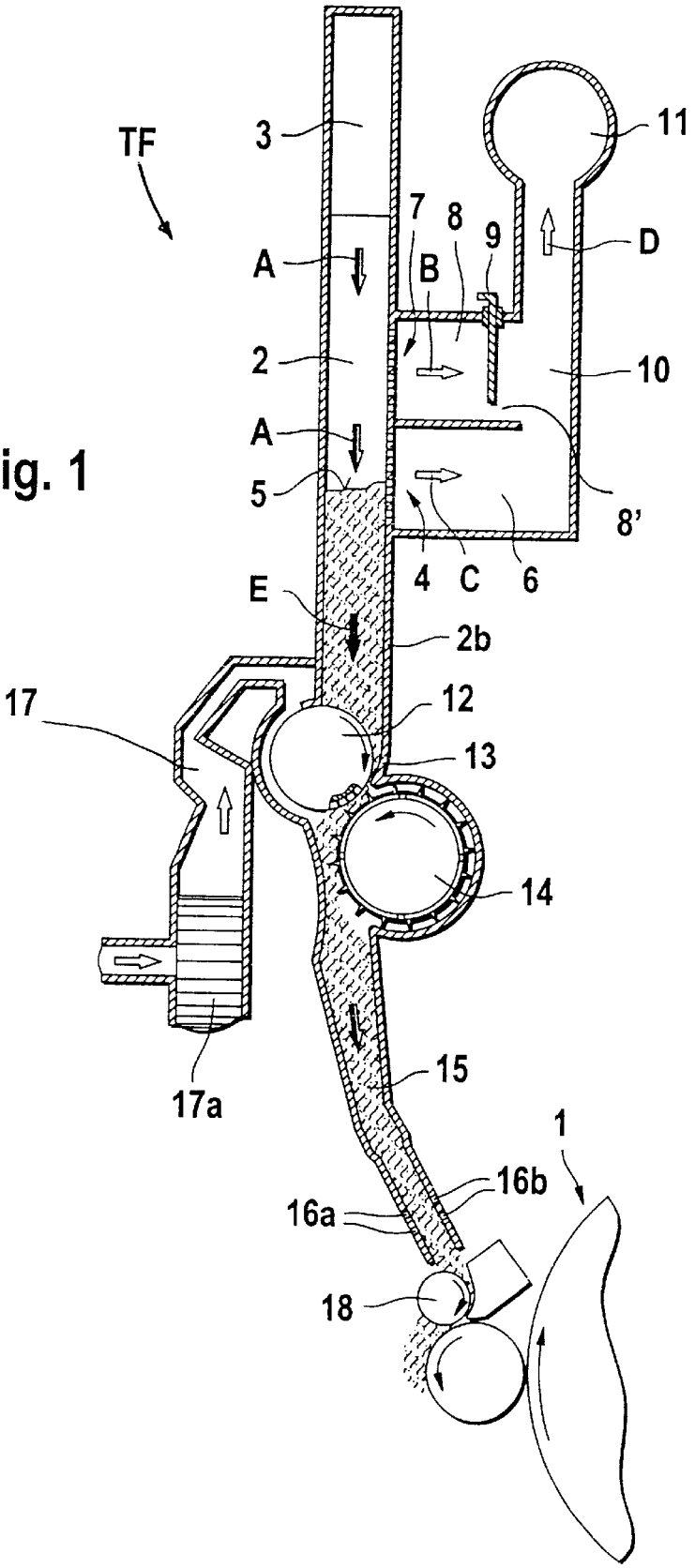
FIG. 1 is schematic sectional side elevational view of a fiber tuft feeder incorporating a preferred embodiment of the invention.

Turning to FIG. 1, a fiber tuft feeder TF is provided upstream (as viewed in the feed direction) of an only symbolically illustrated carding machine 1. As concerns its conventional components, the feeder TF may be, for example, a DIRECTAFEED model, manufactured by Tr ützschler GmbH & Co. KG, Mönchengladbach, Germany. The feeder TF has a reserve chute 2 which is charged from above with a mixture A of air and finely opened fiber material from a condenser through a supply and distributor duct 3.

In the wall 2*b* of the reserve chute 2 a first air-pervious surface 4 is provided, having a plurality of air exit openings. The upper boundary 5 of the deposited fiber tuft column E in the reserve chute 2 is located in the region of the air-pervious surface 4. The air stream C separated from the fiber tufts by the air exit openings of the air-pervious surface 4 enters into an exhaust air chamber 6 which directly adjoins the air-pervious surface 4.

According to the invention, in the wall 2*b* of the reserve chute 2, above the air-pervious surface 4, a second air-pervious (apertured) surface 7 is provided which, in its entirety, is situated above the upper level of the fiber tuft column E and is thus not covered by the fiber tufts. One part of the transport air of the fiber tuft/air mixture A exits through the openings of the air-pervious surface 7 as an air stream B into an immediately adjoining exhaust air chamber 8. The air outflow opening 8' of the exhaust air chamber 8 is provided with an adjustable throttle element such as a slide 9. The exhaust air chambers 6 and 8 merge into a common exhaust air channel 10 in which the air stream D is guided into a suction conduit 11. As shown in FIG. 2*b*, the size of the openings 4' and 7' provided in the respective air-pervious surfaces 4 and 7 is so dimensioned that only the air stream C or, respectively, B may pass therethrough, while the fiber tufts are retained.

The lower end of the reserve chute 2 is obturated by a clockwise slowly rotating feed roll 12 which cooperates with a feed tray 13. The feed roll 12 draws the fiber tuft mass E from the reserve chute 2 and advances it to a counter-clockwise rapidly rotating opening roll 14 which is provided with pins or a sawtooth clothing and which, along a portion of its circumference, faces a feed chute 15. The opening roll 14 supplies the fiber material to the feed chute 15. The feed chute 15 has at its lower end a clockwise rotating withdrawing roll 18 which advances the fiber material to the carding machine 1. The lower wall portions of the feed chute 15 are provided with air exit openings 16*a*, 16*b* up to a certain height. The feed roll 12 and the opening roll 14 continuously supply fiber material at a certain flow rate to the feed chute 15, while fiber material is withdrawn from the feed chute 15 at the same flow rate by the withdrawing roller 18 which advances the fiber material to the carding machine 1.

At its upper portion the feed chute 15 is in communication with a duct 17, one end of which is adjoined by the pressure output of a blower 17*a*. To ensure that the fiber quantity is uniformly compressed and the flow rate is maintained constant, an air stream is driven by the blower 17*a* through the duct 17 and a constriction thereof into and through the fiber material situated in the feed chute 15. Subsequently, the air exits from the lower part of the feed chute 15 through the air outlet openings 16*a*, 16*b*.

Figure 2A:
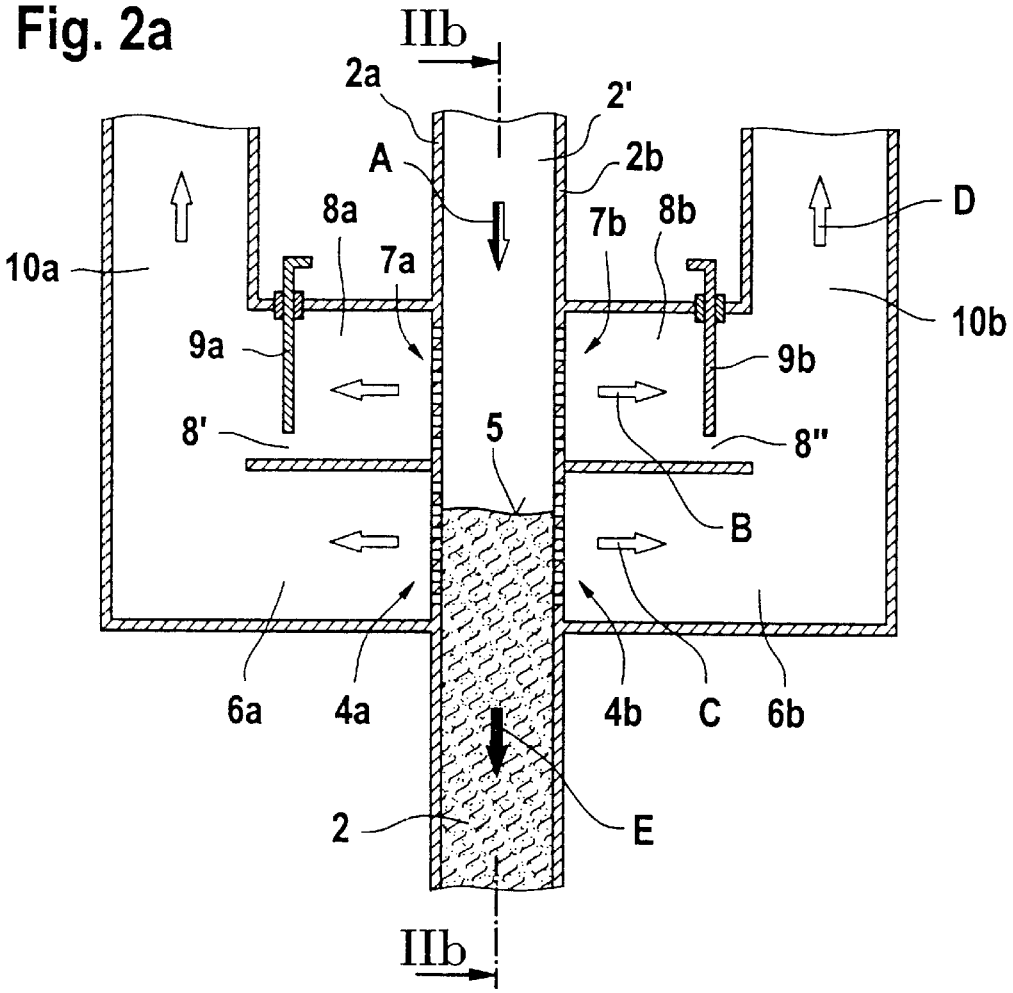
FIG. 2*a* is a fragmentary sectional side elevational view of a further preferred embodiment of the invention.
Figure 2B:
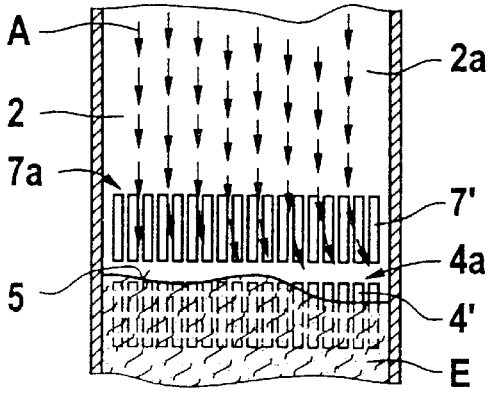
FIG. 2*b* is a fragmentary sectional view taken along line IIb—IIb of FIG. 2*a*.

Turning to FIG. 2*a*, in the two facing walls 2*a* and 2*b* of the reserve chute 2, above the respective first air-pervious wall surfaces 4*a* and 4*b*, second air-pervious wall surfaces 7*a*, 7*b* are positioned. In the region 2' of the reserve chute 2 a high pressure level prevails. In the exhaust air chambers 8*a*, 8*b* coupled to the respective second air-pervious wall surfaces 7*a*, 7*b*, a counter pressure is present which is adjustable by the throttle slides 9*a* and 9*b* disposed in the chambers 8*a* and 8*b*, respectively. No counter pressure prevails in the exhaust air chambers 6*a* and 6*b* adjoining the first air-pervious wall surfaces 4*a*, 4*b*. Thus, a subdivision of the exhaust air region into two chambers 8*a*, 8*b* is effected whose air outflow openings 8' and 8" are adjustable independently from one another. The combination of the exhaust air stream may be effected by merging the chambers into one another. By the integration of the second air-pervious surfaces 7*a* and 7*b* in the chute zone, the subsequent fiber tuft transportation is enhanced by gravity. By the adjustability of the air outflow openings 8' , 8" of the upper exhaust air chambers 8*a*, 8*b* at a constant exit surface the differential pressure may be held small at the second air-pervious surfaces 7*a* and 7*b* which may be formed as a sieve, a perforated plate or a comb structure. The pressure in the exhaust air chambers 8*a*, 8*b* is increased by an increased throttling with the slides 9*a*, 9*b*, until the air stream flowing towards the lower-lying first air-pervious surfaces 4*a*, 4*b* attains the desired flow rate. In this manner, a stepped air exit into the air outlet channels 10*a* and 10*b* may be set in chute portions of different height levels.

As shown in FIG. 2*b*, the transport air automatically guides a greater tuft stream to the location where the fiber material column E in the reserve chute 2 is at its lowest level since there the air stream meets the smallest resistance.

Turning to FIGS. 3*a*, 3*b* and 3*c*, the reserve chute 2 has two facing first air-pervious surfaces 4*a* and 4*b* and, thereabove, two facing respective second air-pervious surfaces 7*a* and 7*b*. The surfaces 4*a*, 4*b*, 7*a* and 7*b* are sieve structures clamped into a frame. The two upper exhaust air chambers 8*a* and 8*b* are, on their side opposite the second air-pervious surfaces 7*a* and 7*b* closed by a terminal wall 20*a* and 20*b*, respectively. In the terminal walls 20*a*, 20*b* four rectangular air outflow openings $\mathbf{8}_1$–$\mathbf{8}_4$ are provided. A respective slide element 21*a* and 21*b* is provided on that side of the terminal walls 20*a* and 20*b* which faces away from the exhaust air chambers 8*a*, 8*b*. The slide element 21*b* (as well as the slide element 21*a*) is displaceable horizontally in the direction of arrows 22 and 23. In the slide elements 21*a* and 21*b* four air passage openings $\mathbf{21}_1$–$\mathbf{21}_4$ are provided which have unlike shapes. In the shown example, they are of approximately triangular or trapezoidal configuration; they may have other (polygonal or curved) shapes as well. The distance a between the air outflow openings $\mathbf{8}_1$–$\mathbf{8}_4$ and the distance b between the air passage openings $\mathbf{21}_1$–$\mathbf{21}_4$ are identical to one another. The slide 21*b* is, according to FIG. 3*b*, in a position in which the air outflow openings $\mathbf{8}_1$–$\mathbf{8}_4$ are closed. In the position shown in FIG. 3*c*, the slide 21*b* has been shifted in the direction of the arrow 22 to such an extent that the air outflow openings $\mathbf{8}_1$–$\mathbf{8}_4$ and the air passage openings $\mathbf{21}_1$–$\mathbf{21}_4$ are partially in a superposed position whereby the air outflow openings $\mathbf{8}_1$–$\mathbf{8}_4$ are partially open, and thus the air stream B may flow from the exhaust air chamber 8*b* into the air outlet channel 10*b*. By virtue of the unlike shape of the air passage openings $\mathbf{21}_1$–$\mathbf{21}_4$ in each instance a different outline of the air outflow openings $\mathbf{8}_1$–$\mathbf{8}_4$ is open. By virtue of the fact that the number of the air outflow openings $\mathbf{8}_1$–$\mathbf{8}_4$ is more than one (in the described embodiment four outflow openings are present), large quantities of air B may be removed in a positively controlled manner. The four air passage openings $\mathbf{21}_1$–$\mathbf{21}_4$ on the horizontally shiftable element 21*a* or 21*b* are simple to manufacture and install. The unlike shapes of the air passage openings $\mathbf{21}_1$–$\mathbf{21}_4$ and the resulting different sizes of the uncovered areas of the air outflow openings $\mathbf{8}_1$–$\mathbf{8}_4$ have the advantage that unlike flow rates through the air outflow openings $\mathbf{8}_1$–$\mathbf{8}_4$ are possible which may be adapted to the non-uniform inflow of the transporting air from the duct 3 into the reserve chute 2 over the width thereof. Such a non-uniform air flow in the region 2' which is caused by the deviation during the inflow, is thus compensated for according to the invention.

It will be understood that the above description of the present invention is susceptible to various modifications, changes and adaptations, and the same are intended to be comprehended within the meaning and range of equivalents of the appended claims.

What is claimed is:

1. A fiber tuft feeder comprising (a) a chute having a chute wall defining a chute interior;

(b) a first air-pervious surface forming part of said chute wall;

(c) a first exhaust air chamber adjoining said first air-pervious surface externally of said chute interior; said first exhaust air chamber being in a pneumatic communication with said chute interior through said first air-pervious surface;

(d) means for charging said chute with an air stream carrying fiber tufts; a first part of the air stream being separated from the fiber tufts by, and passing through, said first air-pervious surface into said first exhaust air chamber whereby a fiber tuft column is formed in said chute interior in a region of said first air-pervious surface;

(e) a second air-pervious surface forming part of said chute wall and being situated upstream of said first air-pervious surface as viewed in a direction of advance of said air stream in said chute interior;

(f) a second exhaust air chamber adjoining said second air-pervious surface externally of said chute interior and being separate from said first exhaust air chamber; said second exhaust air chamber being in a pneumatic communication with said chute interior through said second air-pervious surface for receiving a second part of the air stream;

(g) an air outflow opening provided in a wall of said second exhaust air chamber spaced from said second air-pervious surface; and (h) an adjustable valve cooperating with said air outflow opening for varying a flow passage area thereof.

2. The fiber tuft feeder as defined in claim 1, wherein said chute is generally vertically oriented and further wherein said second air-pervious surface is positioned above said first air-pervious surface.

3. The fiber tuft feeder as defined in claim 1, further comprising an air outflow channel pneumatically communicating with said second exhaust air chamber through said air outflow opening.

4. The fiber tuft feeder as defined in claim 3, wherein said air outflow channel pneumatically communicates with said first exhaust air chamber.

5. The fiber tuft feeder as defined in claim 1, wherein said adjustable valve is a throttle slide.

6. The fiber tuft feeder as defined in claim 1, wherein said chute has a width and further wherein said second air-pervious surface extends along said width.

7. The fiber tuft feeder as defined in claim 1, wherein said air outflow opening is present as a plurality of air outflow openings and further wherein said valve is a shiftable blocking element simultaneously varying a flow passage area of said air outflow openings.

8. The fiber tuft feeder as defined in claim 7, wherein said valve has a plurality of air passage openings cooperating with respective said air outflow openings in said second exhaust air chamber for varying a flow passage area of said air outflow openings.

9. The fiber tuft feeder as defined in claim 8, wherein said air passage openings have unlike shapes.

10. The fiber tuft feeder as defined in claim 8, wherein the flow passage area of said air outflow openings is such that the air stream flowing in said chute is uniform along an entire chute width.

11. The fiber tuft feeder as defined in claim 8, wherein said air passage openings are uniformly spaced.

12. The fiber tuft feeder as defined in claim 8, wherein said air outflow openings are uniformly spaced from one another.

13. The fiber tuft feeder as defined in claim 8, wherein said air passage openings in said valve have shapes different from said air outflow openings in said second exhaust air chamber.

14. The fiber tuft feeder as defined in claim 13, wherein said air outflow openings are one of rectangular and square.

15. The fiber tuft feeder as defined in claim 13, wherein said air passage openings are polygonal.

16. The fiber tuft feeder as defined in claim 15, wherein said air passage openings are one of triangular and trapezoidal.

17. The fiber tuft feeder as defined in claim 7, wherein said blocking element is a slide plate.

18. A fiber tuft feeder comprising (a) a generally vertically oriented chute having a chute wall defining a chute interior; said chute wall having a first wall portion and a second wall portion facing one another;

(b) two first air-pervious surfaces forming part of said first and second wall portions, respectively;

(c) two first exhaust air chambers adjoining said two first air-pervious surfaces externally of said chute interior; said two first exhaust air chambers being in a pneumatic communication with said chute interior through respective said two first air-pervious surfaces;

(d) means for charging said chute with an air stream carrying fiber tufts; a first part of the air stream being separated from the fiber tufts by, and passing through, said two first air-pervious surfaces into said two first exhaust air chambers whereby a fiber tuft column is formed in said chute interior in a region of said two first air-pervious surfaces;

(e) two second air-pervious surfaces forming part of said first and second wall portions, respectively, and being situated above said two first air-pervious surfaces;

(f) two second exhaust air chambers adjoining respective said two second air-pervious surfaces externally of said chute interior and being separate from said two first exhaust air chambers; said two second exhaust air chambers being in a pneumatic communication with said chute interior through respective said two second air-pervious surfaces for receiving a second part of the air stream;

(g) respective air outflow openings provided in a wall of said two second exhaust air chambers spaced from respective said second air-pervious surfaces; and (h) a respective adjustable valve cooperating with the air outflow openings for varying a flow passage area thereof.

19. The fiber tuft feeder as defined in claim 18, wherein said two second air-pervious surfaces each extend throughout a width of said chute.

20. The fiber tuft feeder as defined in claim 18, wherein said two second air-pervious surfaces are in a horizontal alignment with one another.

* * * * *